252-99 AU 166 EX
4/7/81 OR 4,260,507

United States Patent [19]

Barrett

[11] 4,260,507

[45] Apr. 7, 1981

[54] SOAP-SYNTHETIC DETERGENT TABLETS

[75] Inventor: Dennis P. Barrett, Wirral, England

[73] Assignee: Lever Brothers Company, New York, N.Y.

[21] Appl. No.: 76,895

[22] Filed: Sep. 19, 1979

Related U.S. Application Data

[60] Continuation of Ser. No. 873,636, Jan. 30, 1978, abandoned, which is a division of Ser. No. 739,665, Nov. 8, 1976, abandoned, which is a continuation of Ser. No. 586,781, Jun. 13, 1975, abandoned, which is a continuation of Ser. No. 449,181, Mar. 7, 1974, abandoned, which is a division of Ser. No. 172,220, Aug. 16, 1971, abandoned.

[30] Foreign Application Priority Data

Aug. 18, 1970 [GB] United Kingdom ..... 39809/70

[51] Int. Cl.[3] ..... C11D 1/28; C11D 9/30; C11D 9/32; C11D 10/04

[52] U.S. Cl. ..... 252/121; 252/117; 252/134; 252/557; 252/DIG. 16

[58] Field of Search ..... 252/117, 121, 134, 174, 252/538, 557, DIG. 16

[56] References Cited

U.S. PATENT DOCUMENTS

| | | | |
|---|---|---|---|
| 1,906,484 | 5/1933 | Nuesslein | 252/121 |
| 2,527,075 | 10/1950 | Preston | 252/121 |
| 2,781,320 | 2/1957 | Jelinek | 252/121 |
| 2,894,912 | 7/1959 | Geitz | 252/121 |
| 2,982,735 | 5/1961 | Blinka | 252/121 |
| 2,988,511 | 6/1961 | Mills | 252/121 |
| 3,055,837 | 9/1962 | Wittwer | 252/121 X |
| 3,247,121 | 4/1966 | Hendricks | 252/117 |
| 3,376,229 | 4/1968 | Haass | 252/117 |
| 3,625,906 | 12/1971 | Alsbury | 252/121 |

FOREIGN PATENT DOCUMENTS

| | | | |
|---|---|---|---|
| 229443 | 6/1959 | Australia | 252/DIG. 16 |
| 251591 | 6/1963 | Australia | 252/121 |

*Primary Examiner*—Dennis L. Albrecht
*Attorney, Agent, or Firm*—James J. Farrell; Melvin H. Kurtz

[57] ABSTRACT

A personal washing tablet based on tallow soap wherein the lather properties are surprisingly improved by inclusion of up to 40% by weight of active detergent of a defined sulphate/sulphomate synthetic detergent having not more than 10 carbon atoms in a linear chain.

1 Claim, No Drawings

SOAP-SYNTHETIC DETERGENT TABLETS

This application is a continuation application of application Ser. No. 873,632 filed Jan. 30, 1978, now abandoned; which in turn is a divisional application of application Ser. No. 739,665 filed Nov. 8, 1976, now abandoned; which in turn is a continuation application of application Ser. No. 586,781 filed June 13, 1975, now abandoned; which in turn is a continuation application of application Ser. No. 449,181 filed Mar. 7, 1974, now abandoned; which in turn is a divisional application of application Ser. No. 172,220 filed Aug. 16, 1971, now abandoned.

The present invention relates to soap-synthetic detergent toilet tablets, particularly to tallow soap-short alkyl chain synthetic detergent tablets for personal washing.

Tablets made from tallow soap are inadequate in some of the properties necessary for consumer acceptability e.g. the tablets have too low a lather volume even when used in water as hot as 40° C. and the lather is watery and deficient in creaminess. Hitherto the defects have been overcome by blending the tallow with at least 15% nut oil before saponification; several conventional soaps have fat charges in the range 80 tallow/20 nut oil to 50 tallow/50 nut oil. Some of these conventional soaps are superfatted by addition of fatty acids. These soaps have good lathering properties and a tactile quality appreciated by the consumer.

The present invention seeks to provide a personal washing tablet based upon a tallow soap and a synthetic detergent as defined below, which is of lathering performance at least equal to that of the corresponding tallow soap/nut oil soap tablet and which can in some formulations match or improve upon the performance of the conventional tablets described above.

The molecule of the synthetic detergent of the present invention must comprise:

(i) a hydrocarbon chain having a total of 4–12 carbon atoms, there being not more than 10 carbon atoms in a linear chain;

(ii) a group selected from amido, alkyl substituted amido, amino, alkyl substituted amino, and ester;

(iii) an alkali metal, alkaline earth metal, ammonium or substituted ammonium salt of a sulphate or sulphonate group, separated by either a benzene ring or by 1–3 carbon atoms which carbon atoms may be alkyl or (alkyl COO) substituted, from the group (ii) above; and (iv) 8–18 (inclusive) carbon atoms.

In integer (i) above, the hydrocarbon chain may optionally carry a hydroxy substituent. It may be unsaturated or saturated.

The amount of synthetic detergent used is 3–40%, preferably 8–30% by weight of the total active detergent material viz. the tallow soap and the synthetic detergent.

Tallow soap is defined as a sodium, potassium or ammonium salt of which at least 75% is the sodium salt; of either (a) fatty acid derived from tallow class fats, (e.g. beef tallow, mutton tallow, lard, palm oil, or certain vegetable butters) or (b) a blend of fatty acids such that 90% are straight chain fatty acids with 16–24 carbon atoms per molecule, not more than 64% of the molecules being mono unsaturated, and not more than 16% being diunsaturated, the remainder being predominantly saturated.

The preferred cation is sodium. Mixed cations may be used.

The tablets of the present invention comprise water up to about 20% by weight of tablet. Small amounts of electrolyte will also be present. Other ingredients usual in personal washing tablets may be included for example (i) emollients and/or lather modifiers such as higher aliphatic paraffins, fatty alcohols, ethoxylated alcohols and their organic esters, fatty amides and n-alkyl substituted fatty amides, phospho-lipids, higher aliphatic-lower alkyl-ol-amides and their organic esters. (ii) binders and gums, mucilages or synthetic polymeric substances for imparting slip such as starch, starch lower alkyl ethers, starch lower alkoxy ethers, starch lower alkyl carboxy ethers, starch lower alkyl sulphonate ethers, cellulose lower alkyl alkoxy or alkyl sulphonate ethers, locust bean gum, guar gum, slippery elm mucilage, chondroitin sulphate, proteins, peptides, polyacrylamides, very high molecular weight water soluble polymers and copolymers of vinyl alcohol, maleic acid, acrylic acid, itaconic acid, pyrrolidone, allyl alcohol, poly-alkylene oxides optionally with a proportion of the polymerised monomer units carrying a carboxy, sulphate, sulphonate, phosphate or phosphonate ionising group. (iii) colouring agents, opacifiers, pigments, optical brighteners, bactericides, fungicides, preservatives, perfumes, sequestering agents, glucose or glycerine. (iv) minor proportions of further surfactant material preferably, 0–15%.

A superfatting agent to further enhance the lathering property may be included, for example, a fatty acid of carbon atoms numbering 10–18, preferably 10–16. 12-hydroxy stearic acid is particularly preferred. Nut oil soaps or the synthetic equivalent may also be included up to about 10% by weight of the tablet. A particularly good after wash feel is obtained when the tablets of the present invention are superfatted with stearic acid (which may be introduced to the bar by the addition of, for example, tallow fatty acid) or glyceryl monostearate or cetyl alcohol or 12-hydroxy stearic acid or combinations of these.

The tablets may be made by mixing liquid tallow soap, at approximately 62% total fatty matter content, with the desired proportion of short chain alkyl synthetic detergent slurry or paste, drying the mixture to a moisture content of about 10%, adding such ingredients as perfume and pigments, milling the mixed material and extruding bars from conventional toilet soap making equipment.

The preceding general definition describes a number of synthetic detergent molecules which are effective in producing tallow soap-synthetic detergent tablets having consumer acceptable rates of wear, lather volume, and some dispersion. However, there is a preferred area lying within the general framework of the definition above of the synthetic detergent molecule. The preferred molecules satisfy integers (i) to (iv), wherein (iv) is limited to a total number of carbon atoms of from 9–16 inclusive. Typical of these molecules are the following:

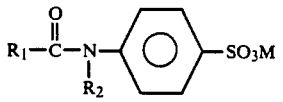

1.

wherein $R_1$ is alkyl $C_4$–$C_9$ and $R_2$ is alkyl $C_1$–$C_5$ or H, or wherein $R_1$ is H or alkyl $C_1$–$C_5$ and $R_2$ is alkyl $C_4$–$C_9$.

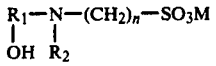

2.

wherein $R_1$ is alkyl $C_4$–$C_{12}$, $R_2$ is alkyl $C_1$–$C_{11}$ or H, and n is 1–3, or wherein $R_1$ is alkyl $C_1$–$C_{11}$, $R_2$ is alkyl $C_4$–$C_{12}$, and n is 1–3.

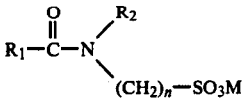

3.

wherein either $R_1$ is an alkyl of $C_4$–$C_{12}$, $R_2$ is an alkyl of $C_1$–$C_{10}$ or H, and n is 1–3, or $R_1$ is alkyl $C_1$–$C_{10}$ or H, $R_2$ is alkyl $C_4$–$C_{12}$ and n is 1–3.

Particularly preferred are molecules which satisfy integer (i) and have total carbon number 9–16 where the group of integer (ii) is an ester group, and integer (iii) is a sulphonate moiety separated from this ester group by an alkyl chain of 1–3 carbon atoms, optionally the carbon atom adjoining the sulphonate is alkyl-carboxy substituted as in class 6 below.

Molecules of this type are exemplified by the following structures:

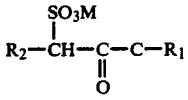

4.

wherein $R_1$ is alkyl $C_4$–$C_{12}$ and $R_2$ is alkyl $C_1$–$C_{10}$, or wherein $R_2$ is alkyl $C_4$–$C_{12}$ and $R_1$ is alkyl $C_1$–$C_{10}$.

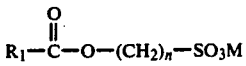

5.

wherein R is an alkyl of $C_5$–$C_{12}$ and n is 1–3.

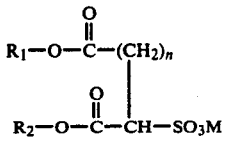

6.

wherein $R_1$ is alkyl $C_4$–$C_{12}$, $R_2$ is alkyl $C_1$–$C_8$ or H, and n is 1 or 2, or $R_1$ is alkyl $C_1$–$C_8$ or H, $R_2$ is alkyl $C_4$–$C_{12}$ and n is 1 or 2.

In the foregoing structural formulae, M is a cation selected from an alkali metal, an alkaline earth metal, ammonium and substituted ammonium.

The present invention will now be described by way of Examples of toilet tablets in which the synthetic detergent ws used with sodium tallow soap of 78% TFM in a tablet at the percentage level tabulated, expressed by weight of active material and water viz. by weight of the specified synthetic detergent and the sodium tallow soap at 78% TFM. The tests by which the properties were assessed are given later. The cation of the synthetic detergent is sodium. The remaining ingredients of the tablets were composed of those usual in this art, the lathering properties of the formulations being dependent upon the type of synthetic detergent molecule. The Examples designated A–F are tabulated to show the synergistic lather volumes demonstrated by the tallow soap-synthetic detergent tablets of the present invention.

| Example No. | Synthetic Detergent | % Level | Lather Vol. % 20° | Rate of Wear 20° | Scum Dispersion 20° |
|---|---|---|---|---|---|
| 1 | n-octyl ester of sodium alpha-sulpho-caprylate (class 4) | 30 | 492 | 15.0 | 12.5 |
| 2 | n-octyl ester of sodium alpha-sulpho-caprylate (class 4) | 15 | 338 | 12.2 | 10 |
| A | n-octyl ester of sodium alpha-sulfocaprylate (class 4) | 100 | 742 | | |
| 3 | Sodium caproyl isothionate (class 5) | 30 | 542 | 30.7 | 3 |
| 4 | sodium caproyl isothionate (class 5) | 15 | 508 | 21.1 | 3 |
| 5 | Sodium caproyl isothionate (class 5) | 5 | 308 | 18.6 | 3.5 |
| B | Sodium caproyl isothionate (class 5) | 100 | 600 | | |
| 6 | Sodium N-caproyl-N-methyl tauride (class 3) | 30 | 413 | 27.5 | 4.5 |
| 7 | Sodium N-caproyl-N-methyl tauride (class 3) | 15 | 354 | 16.3 | 5.5 |
| 8 | Sodium di-(methyl aryl)-sulpho-succinate (class 5) | 30 | 417 | — | — |
| 9 | Sodium di-(methyl amyl)-sulpho-succinate (class 5) | 13 | 450 | — | — |
| 10 | Sodium di-(methyl amyl)-sulpho-succinate (class 5) | 5 | 366 | — | — |
| 11 | Sodium di-(isobutyl)-sulpho-succinate (class 6) | 30 | 453 | — | — |
| 12 | Sodium di-(isobutyl)-sulpho-succinate (class 6) | 15 | 402 | — | — |
| 13 | Sodium di-(isobutyl)-sulpho-succinate (class 6) | 5 | 307 | — | — |
| 14 | Sodium N-(caproyl)-p-amino benzene sulphonate (class 1) | 30 | 388 | 15.0 | 3.5 |
| C | Sodium N-(caproyl)-p-amino benzene sulphonate (class 1) | 100 | 17 | | |

-continued

| Example No. | Synthetic Detergent | % Level | Lather Vol. % 20° | Rate of Wear 20° | Scum Dispersion 20° |
|---|---|---|---|---|---|
| 15 | Sodium, N-(2-hydroxy n-octyl),N-methyl-1-amino ethane-2-sulphonate (class 2) | 30 | 513 | 22.2 | 5 |
| D | Sodium, N-(2-hydroxy n-octyl), N-methyl-1-amino ethane-2-sulphonate (class 2) | 100 | nil | | |
| E | 100% tallow soap | 0 | 98 | 13.5 | 3.0 |
| F | 80 tallow/20 nut oil soap | 0 | 336 | 18.1 | 3.0 |

Some of the foregoing tablets, according to the invention, were superior in lather volume to the extent of matching the lather volume performance of a 50 sodium tallow soap/50 sodium nut oil soap/7½ superfat consisting of the fatty acids corresponding to the fat charge.

The equivalent or superior tablets were those detailed above under Examples Nos. 1, 3, 4, 9, 11, and 15.

The lather creaminess values on the standard test described in our earlier patent specifications, are not quoted but are substantially similar to those as determined for the tallow soap/nut oil soap tablets.

EXAMPLE 16

The criticality of the carbon atoms in the synthetic detergent molecule class designated 5 wherein n=2, is demonstrated below. Tablets were made by adding sodium n-acyl isethionate (class 5) to 78% TFM sodium tallow soap in the proportions described below. The samples of the isethionate were typical of those that would be obtained from a commercial process. The total tablet formulations so produced therefore contained a small proportion of fatty acid and soap deriving from the isethionate, constituting in total not more than 4% by weight of the total active material. The final tablets contained in addition the following minor ingredients: 0.2% titanium dioxide, 1% perfume, 0.04% preservative, 10% water. The Comparative compositions lie outside the present invention and are included as proof of the criticality of the integers of the definition of the synthetic detergent.

| | Parts by Weight | | Syndet Carbon Atoms | | | Lather Volume % | | Creaminess | |
|---|---|---|---|---|---|---|---|---|---|
| | Soap | Syndet | R | Linear | Total | 20° C. | 40° C. | 20° C. | 40° C. |
| | 85 | 15 | 5 | 6 | 8 | 308 | 404 | 2.1 | 2.3 |
| | 85 | 15 | 7 | 8 | 10 | 508 | 508 | 2.8 | 2.9 |
| | 85 | 15 | 9 | 10 | 12 | 500 | 433 | 2.6 | 2.8 |
| Comparative | 85 | 15 | 11 | 12 | 14 | 142 | 196 | 1.8 | 1.8 |
| | 95 | 5 | 5 | 6 | 8 | 225 | 213 | 2.1 | 2.0 |
| | 95 | 5 | 7 | 8 | 10 | 308 | 317 | 2.2 | 2.0 |
| | 95 | 5 | 9 | 10 | 12 | 283 | 304 | 2.1 | 2.0 |
| Comparative | 95 | 5 | 11 | 12 | 14 | 92 | 146 | 1.4 | 1.7 |
| | 70 | 30 | 7 | 8 | 10 | 542 | 550 | 3.3 | 3.8 |
| Comparative | 70 | 30 | 11 | 12 | 14 | 279 | 242 | 2.2 | 2.2 |
| Control | 100 | — | — | — | — | 150 | 153 | 1.9 | 1.8 |
| Control | | 100 | 5 | 6 | 8 | Nil | Nil | — | — |
| | | 100 | 7 | 8 | 10 | — | 400 | — | — |
| | | 100 | 9 | 10 | 12 | — | 600 | | |

The foregoing tablets according to the invention were, in general, equivalent in lather volume and creaminess properties to conventional and commercial sodium tallow/sodium coconut soaps.

EXAMPLE 17

Branched acyl isethionates derived from synthetic fatty acids wherein the carboxyl group is attached to varying carbon atoms in the alkyl group were used. These are of class 5 detergents.

| Acyl isethionate from synthetic fatty acids of carbon atoms numbering: | Level Parts by weight | Leather Volume % 20° C. | Leather Volume % 40° C. | Creaminess 20° C. | Creaminess 40° C. |
|---|---|---|---|---|---|
| $C_9$ from about 72% 1-acid; 19% | 15 | 488 | 421 | 2.6 | 2.5 |
| octane 2-carboxylic acid; 5% octane 3-carboxylic acid and 4% octane 4-carboxylic acid | 5 | 358 | 288 | 2.2 | 2.4 |
| $C_{11}$ from about 57% 1-undecanoic acid; 23% | 15 | 333 | 246 | 2.1 | 2.2 |
| undecane-2-carboxylic acid; 6% undecane-3-carboxylic acid and 14% undecane 4,5 and 6 carboxylic acids | 5 | 287 | 221 | 2.0 | 2.1 |

EXAMPLE 18

Superfatted tablets derived from 20 parts sodium acyl isethionate and 80 parts sodium tallow soap at 78% TFM to which 20 parts stearic acid were added. The ingredients were milled together with 1% perfume, 0.2% $TiO_2$, 0.04% preservative. The water content was adjusted to about 10%. The plodded tablets gave the following results.

| Syndet Carbon No. | | | Lather Volume % | | Creaminess | |
|---|---|---|---|---|---|---|
| R | Linear | Total | 20° C. | 40° C. | 30° C. | 40° C. |
| 5 | 6 | 8 | 271 | 258 | 2.1 | 2.1 |
| 9 | 10 | 12 | 567 | 525 | 3.0 | 3.0 |

EXAMPLE 19

Further evidence of the criticality of the carbon number of the synthetic detergent molecule is provided by the following results in which the tablets had an active detergent material only sodium tallow soap of 78% TFM and sodium sulphosuccinate. (Synthetic detergent molecule class 6).

| Parts by Weight | | Syndet Carbon | | Lather Volume % | | Creaminess | |
|---|---|---|---|---|---|---|---|
| Soap | Syndet | $R_1$ | $R_2$ | 20° C. | 40° C. | 20° C. | 40° C. |
| 85 | 15 | 4 | 4 | 496 | 458 | 2.8 | 2.7 |
| 95 | 5 | 4 | 4 | 346 | 338 | 2.2 | 2.4 |
| 85 | 15 | 6 | 6 | 438 | 388 | 2.7 | 2.6 |
| 95 | 5 | 6 | 6 | 267 | 246 | 2.0 | 2.2 |
| Control | 100 | 4 | 4 | Nil | Nil | — | — |
| | 100 | 6 | 6 | — | 400 | — | — |
| Comparatives | | | | | | | |
| 85 | 15 | 8 | 8 | 217 | 217 | 2.1 | 2.0 |
| 95 | 5 | 8 | 8 | 188 | 183 | 2.0 | 2.0 |
| 85 | 15 | 10 | 10 | 75 | 75 | 1.5 | 1.7 |
| 95 | 5 | 10 | 10 | 96 | 133 | 1.8 | 2.1 |

EXAMPLE 20

Superfatting of the tablets according to Example 19 using 15 parts by weight stearic acid gave the following results.

| Parts by Weight | | Syndet Carbons | | Leather Volume % | | Creaminess | |
|---|---|---|---|---|---|---|---|
| Soap | Syndet | $R_1$ | $R_2$ | 20° C. | 40° C. | 20° C. | 40° C. |
| 85 | 15 | 4 | 4 | 329 | 342 | 2.5 | 2.6 |
| 85 | 15 | 6 | 6 | 583 | 246 | 2.0 | 2.2 |

Similar results were obtained by use of 12-hydroxy stearic acid in place of the above stearic acid: although the creaminess was improved.

EXAMPLE 21

The following tablets were made from sodium tallow soap of 78% TFM and the specified sodium sulphosuccinate.

| Parts by weight | | Syndet Carbons | | Lather Volume % | | Creaminess | |
|---|---|---|---|---|---|---|---|
| Soap | Syndet | $R_1$ | $R_2$ | 20° C. | 40° C. | 20° C. | 40° C. |
| 85 | 15 | 10 | H | 342 | 496 | 2.2 | 2.4 |
| 95 | 5 | 10 | H | 238 | 242 | 2.1 | 2.0 |

When superfatted with 15 parts by weight stearic acid:

| Parts by Weight | | Syndet Carbons | | Lather Volume % | | Creaminess | |
|---|---|---|---|---|---|---|---|
| Soap | Syndet | $R_1$ | $R_2$ | 20° C. | 40° C. | 20° C. | 40° C. |
| 85 | 15 | 10 | H | 388 | 338 | 2.3 | 2.5 |
| Control 100 | — | 10 | H | — | 300 | — | — |

12-hydroxy stearic acid may be used as the superfatting agent with similar results.

EXAMPLE 22

The following tablets were made using class 4 molecules ie the alpha-sulpho fatty acid esters and 78% TFM sodium tallow soap.

| Parts by Weight | | Syndet Carbons | | Lather Volume % | | Creaminess | |
|---|---|---|---|---|---|---|---|
| Soap | Syndet | $R_1$ | $R_2$ | 20° C. | 40° C. | 20° C. | 40° C. |
| 90 | 10 | 1 | 6 | 325 | 350 | 2.2 | 2.4 |
| 97 | 3 | 1 | 6 | 250 | 275 | 2.1 | 2.3 |
| 90 | 10 | 5 | 2 | 363 | 375 | 2.1 | 2.4 |
| 97 | 3 | 5 | 2 | 200 | 225 | 2.4 | 2.1 |
| Controls | 100 | 1 | 6 | Zero | — | — | — |
| | 100 | 5 | 2 | 200 | — | — | — |
| Comparative | | | | | | | |
| 90 | 10 | 1 | 4 | 175 | 192 | 1.9 | 2.1 |
| 97 | 3 | 1 | 4 | 142 | 171 | 1.9 | 1.9 |

EXAMPLE 23

Potassium n-hexanoyl isethionate was added at 15% to sodium tallow soap (78% TFM).

The resulting bar had a lather volume much superior to that of the corresponding and conventional formulation containing nut oil soap and tallow soap.

EXAMPLE 24

The formulation of Example 9 was superfatted by the addition of 15% of 12-OH stearic acid which was milled into the soap base. 1% perfume, 0.2% $TiO_2$, and 0.04% preservative were added and milled into the base material. The water content was adjusted to about 5%. The resulting mixture was plodded and stamped to give a bar with only slightly reduced lather and enhanced creaminess in respect of the bar of Example 9. The skin compatibility of the formulation was improved by the addition of the superfat.

EXAMPLE 25

A mixture was made from sodium tallow soap (78% TFM) and 15% sodium di n-hexyl sulphosuccinate. To this mixture was added 10% stearic acid and 5% sodium n-dodecyl sulphate, as further surfactant material to enhance scum dispersion. The water content was adjusted to 5%. The whole mixture was milled and plodded to produce a bar with extremely good lather and tablet properties.

EXAMPLE 26

A tallow soap base was made of 90% sodium salt and 10% potassium salt. This was used in place of the sodium tallow soap of Example 2. The resulting bar was similar in properties to that of Example 2.

EXAMPLE 27

Example 24 was repeated using a 1:1 mixture of stearic acid and cetyl alcohol as superfat—the resulting bar was similar in properties to that of Example 24, and had good skin compatibility.

EXAMPLE 28

The active detergent of Example 22 where $R_1=1$ and $R_2=6$ was added at 15% to sodium tallow soap. The resulting base was superfatted with 10% stearic acid and 5% tetradecanol. The water content was adjusted to about 5% and the mixture plodded and stamped to give a bar of good lather and skin feel.

EXAMPLE 29

The active detergent of Example 19 where $R_1=4$ and $R_2=4$ was added at 15% to sodium tallow soap (78% TFM). 3% of dodecanol-3EO was added as a scum inhibitor. The resulting tablet had enhanced scum dispersing power.

EXAMPLE 30

A base was prepared from 93% sodium tallow soap and 7% sodium coconut soap. This soap base was then used in combination with the following synthetic detergents:

| | | |
|---|---|---|
| 15% | sodium acyl isothionate | $R = 7$ |
| 15% | sodium sulphosuccinate | $R_1 = R_2 = 4$ |
| 15% | sodium alpha-sulpho fatty acid ester | $R_1 = 5$<br>$R_2 = 2$ |

The resulting bars were essentially similar to those of the corresponding Examples using only sodium tallow soap.

Tests used:

Lather volume

The tablets have each been subjected to a lather volume test in which a panel of testers each used each tablet in a standard way and measured the volume of lather so produced. Each tester made two determinations at water temperatures of 20° and 40° C. and results for each tablet at each temperature are averages. The "lather volume %" results given below are percentages of the lather volume as given by a tallow soap which contains no synthetic detergent.

Rate of water—handwashing test

A panel of testers working in rotation washed down each tablet in water at 20° C. 6 times per day for 4 days. Each washdown consisted of 40 twists, a twist being defined as a rotation of the tablet through 180° in the hands of the tester. Tablets of the same shape and size are used and are kept on drained dishes between washdowns. The tablets were air dried usually for 2 days, and the rate of wear results quoted are "dry weight loss in grams".

Scum dispersion

Five characteristics of toilet tablet behaviour made up the scum dispersion assessment: initial lather, water surface, bulk wash water, draining and rinsing, wherein the tablet perfect in all 5 characteristics would rate 20. The test was done in a black porcelain wash basin having a drain plug. A gallon of water at 20° C. was placed in the bowl, the tester picked up an already washed down tablet and (i) dipped it into the water, twisted it 10 times between hands and replaced it on a drainer tray, (ii) generated lather by rubbing hands together 10 times, (iii) dipped hands in the water to float off the lather, (iv) repeated (i)-(iii), (v) gave 10 vigorous strokes across the water surface to mix the surface lather and the bulk wash water.

Creaminess test

The creaminess test is carried out in the same manner as the lather volume test. The assessor rates the lather for creaminess according to the scale:

1 = non-creamy
2 = slightly creamy
3 = moderately creamy
4 = very creamy
5 = extremely creamy It is found that most commercially acceptable tablets are rated between 2 and 4.

What is claimed is:

1. A personal washing tablet consisting essentially of an active detergent material and up to 20% by weight of water, said active detergent material being a mixture of:
   (a) 60–97% by weight of an alkali metal tallow soap of which at least 75% is the sodium salt, and
   (b) 3–40% by weight of a synthetic detergent having the structure $$R-\overset{\overset{\displaystyle O}{\|}}{C}-O-(CH_2)_n-SO_3M,$$

wherein R is a $C_5$–$C_9$ alkyl group, n is 1–3, and M is an alkali metal cation.

* * * * *